US009872102B2

(12) United States Patent
Yoo

(10) Patent No.: US 9,872,102 B2
(45) Date of Patent: Jan. 16, 2018

(54) MICROPHONE DEVICE AND CONTROL METHOD THEREOF

(71) Applicant: HYUNDAI MOTOR COMPANY, Seoul (KR)

(72) Inventor: Ilseon Yoo, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 158 days.

(21) Appl. No.: 14/853,524

(22) Filed: Sep. 14, 2015

(65) Prior Publication Data

US 2016/0157011 A1 Jun. 2, 2016

(30) Foreign Application Priority Data

Nov. 28, 2014 (KR) ..... 10-2014-0169042

(51) Int. Cl.
*H04R 3/00* (2006.01)

(52) U.S. Cl.
CPC ..... *H04R 3/00* (2013.01); *H04R 2410/01* (2013.01); *H04R 2499/13* (2013.01)

(58) Field of Classification Search
CPC ..... H04R 3/00
USPC ..... 381/357
See application file for complete search history.

(56) References Cited

U.S. PATENT DOCUMENTS

2006/0285714 A1* 12/2006 Akino ..... H04R 1/326 381/356
2010/0303273 A1* 12/2010 Sawada ..... H04R 1/406 381/361
2014/0233756 A1* 8/2014 Inoda ..... H04R 1/38 381/91

FOREIGN PATENT DOCUMENTS

| | | | |
|---|---|---|---|
| JP | 4505035 | B1 | 7/2010 |
| KR | 10-2006-0056010 | A | 5/2006 |
| KR | 10-0631285 | B1 | 10/2006 |
| KR | 10-0722687 | B1 | 5/2007 |
| KR | 10-0740462 | B1 | 7/2007 |
| KR | 10-0874470 | B1 | 12/2008 |
| KR | 10-1089828 | B1 | 12/2011 |

OTHER PUBLICATIONS

Thompson, S.C., "Tutorial on microphone technologies for directional hearing aids", The Hearing Journal, Nov. 2003, vol. 56, No. 11, pp. 14-21.

* cited by examiner

*Primary Examiner* — Matthew Eason
*Assistant Examiner* — Phan Le
(74) *Attorney, Agent, or Firm* — McDermott Will & Emery LLP

(57) ABSTRACT

A microphone device includes a case having a sound hole and a phase delay membrane. A plurality of non-directional microphones disposed in the case. A semiconductor chip is connected to the non-directional micro electro mechanical system (MEMS) microphones and operating in response to input signals, in which any one of the non-directional microphones forms a directional microphone by being connected with the sound hole and the phase delay membrane of the case.

10 Claims, 4 Drawing Sheets

MICROPHONE DEVICE AND CONTROL METHOD THEREOF

CROSS-REFERENCE TO RELATED APPLICATION

This application claims the benefit of priority to Korean Patent Application No. 10-2014-0169042 filed in the Korean Intellectual Property Office on Nov. 28, 2014, the entire content of which is incorporated herein by reference.

TECHNICAL FIELD

The present disclosure relates to a microphone device and a method of controlling the microphone device. More particularly, the present disclosure relates to a microphone device that can selectively operate a microphone, depending on noisy environments in a vehicle, and a method of controlling the microphone device.

BACKGROUND

In general, a microphone is a device converting sound into an electrical signal, and used for mobile communication devices such as a terminal, and various communication devices such as an earphone or a hearing aid. Such a microphone requires high audio performance, reliability, and operability.

A capacitive microphone based on microelectromechanical system (MEMS) (hereafter simply referred to as a "MEMS microphone") has high audio performance, reliability, and operability, as compared with an electret condenser microphone (hereafter simply referred to as an "ECM microphone").

The MEMS microphone is classified into a non-directional (omnidirectional) microphone and a directional microphone, depending on the directional characteristics.

The non-directional microphone has uniform sensitivity for sound waves traveling inside in all directions.

On the other hand, the directional microphone has different sensitivity depending on the directions of incident sound waves, and falls into a unidirectional type and a bidirectional type in accordance with the directional characteristics.

For example, the directional microphone is used for recording in a narrow room or capturing only desired sounds in a room with a lot of reverberation.

When these microphones are mounted in a vehicle, sound sources are far from them and noise is variably generated due to the environmental characteristics of the vehicle. Thus, there is a need for a microphone that is strong against changes in the noisy environment inside the vehicle, and for this purpose, the directional MEMS microphone that captures sounds only in desired directions is used.

However, since the directional microphone of the related art captures sounds only in desired directions, it is strong against noise, but the sensitivity is low and the frequency response characteristic is poor compared with the non-directional microphone.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide a microphone device having advantages of being suitable for an environment with variable noise in a vehicle, and a method of controlling the microphone device.

According to an exemplary embodiment of the present inventive concept, a microphone device includes a case having a sound hole and a phase delay membrane. A plurality of non-directional microphones are disposed in the case. A semiconductor chip is connected to the non-directional microphones and operates in response to input signals, in which any one of the non-directional microphones may form a directional microphone by connecting to the sound hole and the phase delay membrane of the case.

The non-directional microphone may include a substrate having a penetration hole. A vibrating membrane is disposed on the substrate. A fixed membrane is spaced apart from the vibrating membrane.

The phase delay membrane may be connected to the penetration hole of any one of the non-directional microphones.

The non-directional microphones may include a first non-directional microphone and a second non-directional microphone.

The second non-directional microphone may form a directional microphone by being connected with the sound hole and the phase delay membrane of the case.

The semiconductor chip may measure a noise voltage to a sound voltage sensed by the first non-directional microphone, and may determine whether the noise voltage is more than a reference voltage set in advance in the semiconductor chip, when a sound processor starts to operate.

The semiconductor chip may operate the first non-directional microphone, when the noise voltage is less than the reference voltage set in the semiconductor chip.

The semiconductor chip may operate the second non-directional microphone as the directional microphone, when the noise voltage is more than the reference voltage set in the semiconductor chip.

The case may have any one of the shapes of a circular cylinder and a rectangular cylinder.

The sound processor may be at least any one of a speech recognition device, a hands-free device, and a portable communication terminal.

According to another exemplary embodiment of the present inventive concept, a method for controlling a microphone device includes operating a first non-directional microphone, when a sound processor starts to operate. A sound voltage generated by the first non-directional microphone is transmitted to a semiconductor chip. A noise voltage of the sound voltage is measured, and compares with a reference voltage set in advance in the semiconductor chip. The first non-directional microphone operates, when the noise voltage is less than the reference voltage. The operation of the sound processor stops.

The method may further include operating the second non-directional microphone as a directional microphone, when the noise voltage is more than the reference voltage, after comparing.

According to the exemplary embodiment of the present inventive concept, since a directional microphone and a non-directional microphone are provided, it is possible to selectively operate the directional microphone and the non-directional microphone in an environment with variable noise in a vehicle.

That is, since a directional microphone having excellent directionality for noise and a non-directional microphone having excellent sensitivity and frequency response are implemented, when a noise voltage less than a reference voltage set in advance in the semiconductor chip is applied, the non-directional microphone operates. When a noise voltage over the reference voltage is applied, the directional microphone operates, thus achieving a high signal-to-noise ratio (SNR).

Further, effects that can be obtained or expected from exemplary embodiments of the present inventive concept are directly or suggestively described in the following detailed description. That is, various effects expected from exemplary embodiments of the present inventive concept will be described in the following detailed description.

DETAILED DESCRIPTION OF THE EMBODIMENTS

Hereinafter, exemplary embodiments of the present inventive concept will be described with reference to the accompanying drawings. However, the drawings to be described below and the following detailed description relate to one exemplary embodiment of various exemplary embodiments for effectively explaining the characteristics of the present inventive concept. Therefore, the present disclosure should not be construed as being limited to the drawings and the following description.

Further, in the description of the present disclosure, the detailed description of related well-known configurations and functions is not provided when it is determined as unnecessarily making the scope of the present disclosure unclear. In addition, the terminologies to be described below are ones defined in consideration of their function in the present disclosure, and may be changed by the intention of a user, an operator, or a custom. Therefore, their definition should be determined on the basis of the description of the present disclosure.

Further, in the following exemplary embodiments, the terminologies are appropriately changed, combined, or divided so that those skilled in the art can clearly understand them, in order to efficiently explain the main technical characteristics of the present disclosure, but the present disclosure is not limited thereto.

Hereinafter, exemplary embodiments of the present inventive concept will be described in detail with reference to the accompanying drawings.

Figure 1:
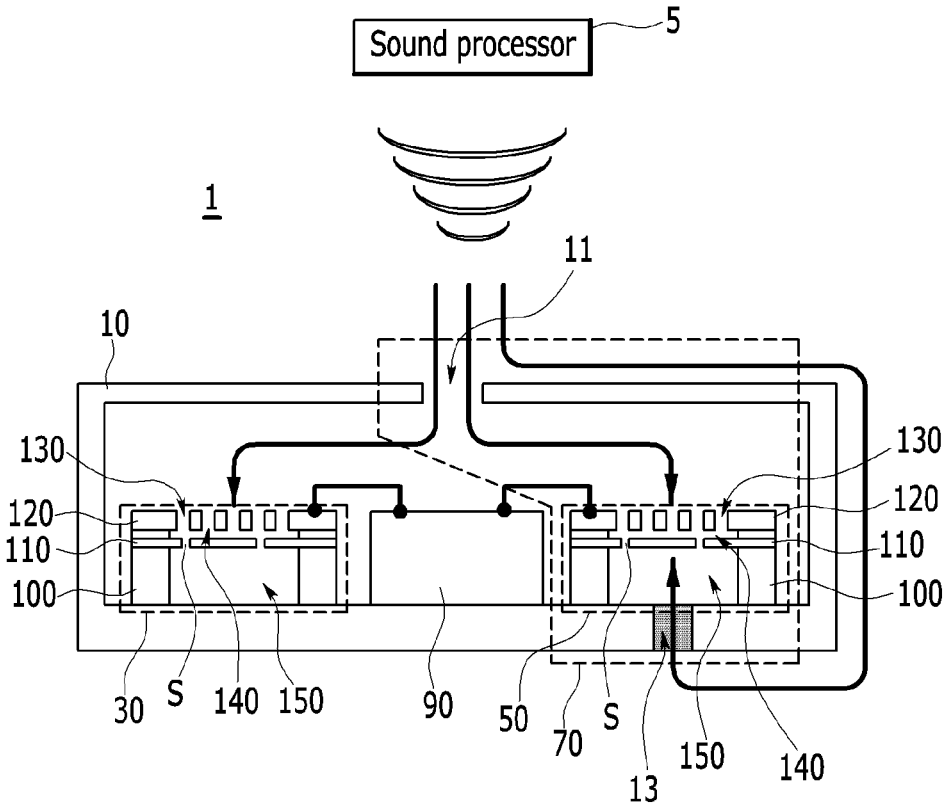
FIG. 1 is a schematic diagram showing a microphone device according to an exemplary embodiment of the present inventive concept.
Figure 2A:
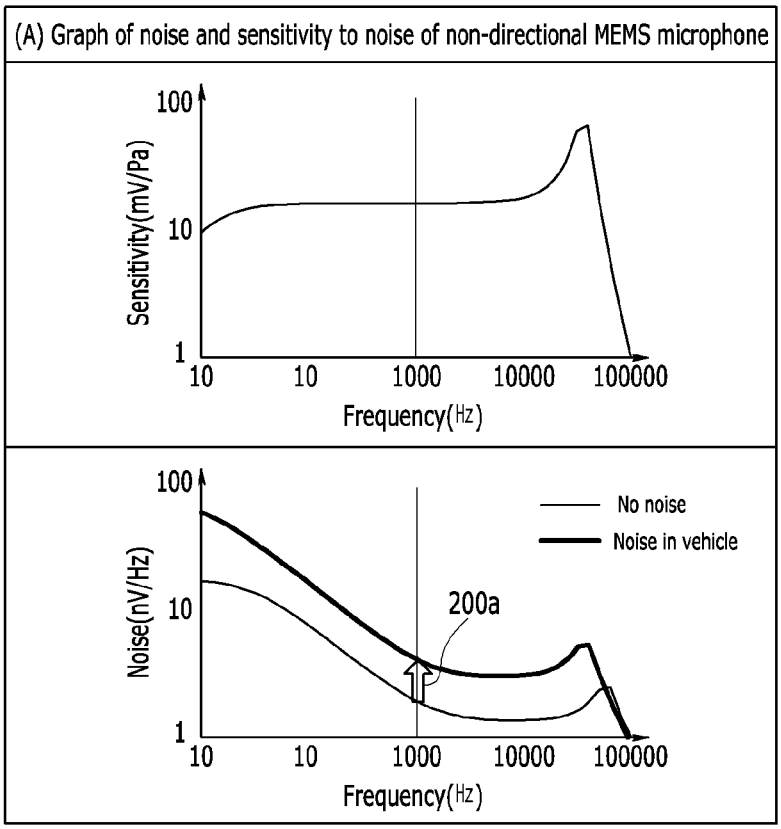
FIGS. 2A and 2B are graphs showing performance for a non-directional microphone and a directional microphone, respectively, according to an exemplary embodiment of the present inventive concept under a noisy environment.
Figure 2B:
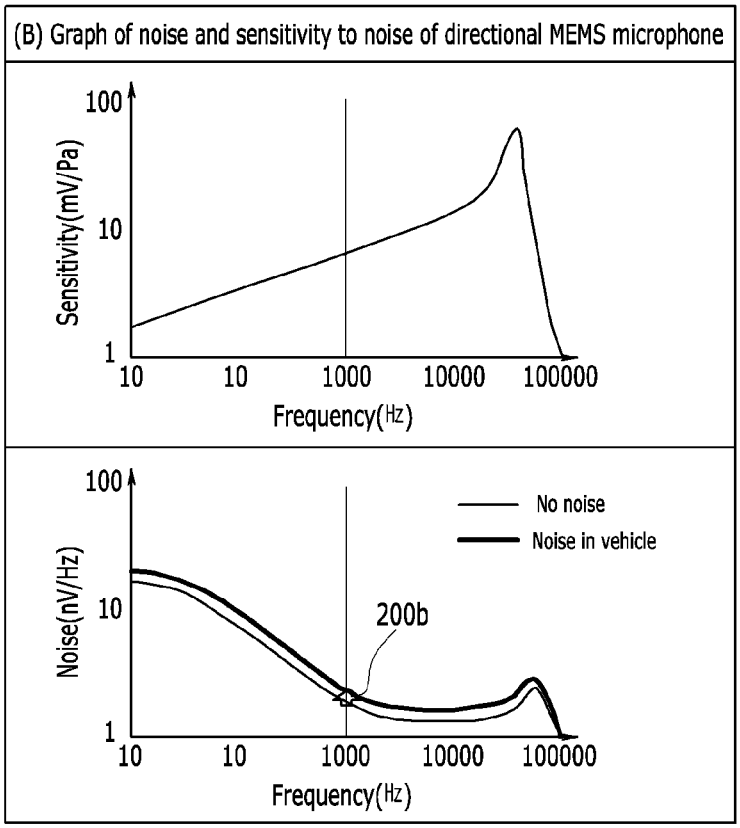

FIG. 1 is a schematic diagram showing a microphone device according to an exemplary embodiment of the present inventive concept, and FIGS. 2A and 2B are graphs showing performance for each type of microphone device according to an exemplary embodiment of the present inventive concept under a noise environment.

Referring to FIG. 1, a microphone device 1 according to an exemplary embodiment of the present inventive concept includes a case 10, a plurality of non-directional microphones 30 and 50, and a semiconductor chip 90.

The case 10 has a sound hole 11 formed through the top and a phase delay membrane 13 formed on the bottom of the case 10.

The sound hole 11 is a hole through which sound from a sound processor 5 travels, and the sound traveling inside through the sound hole 11 travels to the non-directional microphones 30 and 50.

The sound processor 5, which processes voice in a vehicle, may be at least one of a speech recognition device, a hands-free device, and a portable communication terminal.

When a driver gives an order by voice, the sound processor 5 recognizes and performs the order from the driver.

The hands-free device is connected with the portable communication terminal through local wireless communication, so that drivers can freely speak without the portable communication terminal in their hands.

The portable communication terminal, which can perform wireless phone call, may be a smart phone or a personal digital assistant (PDA).

Although the sound hole 11 is formed at the center of the microphone device 1, it is not limited thereto, and the position may be changed as necessary.

The phase delay membrane 13 delays the phase of sound traveling inside from the external sound processor 5, and then allows it to travel to the second microphone 50 to be described below.

The phase delay membrane 13 is in contact with a penetration hole 150 of the second non-directional microphone 50.

The case 10 having the sound hole 11 and the phase delay membrane 13 may be made of any one of metal and ceramic. The case 10 may have a circular cylinder shape or a rectangular cylinder shape.

Although two non-directional microphones 30 and 50 are symmetrically arranged in the case 10 in the exemplary embodiment, they are not limited thereto, and their positions may be changed as necessary.

The non-directional microphones 30 and 50 may be achieved by a microelectromechanical system (MEMS), and each includes a substrate 100, a vibrating membrane 110, and a fixed membrane 120.

The substrate 100 may be made of silicon and has the penetration hole 150.

The vibrating membrane 110 is exposed by the penetration hole 150 and is disposed on the substrate 100.

The vibrating membrane 110 has a plurality of slots S.

The fixed membrane 120 is spaced from the vibrating membrane 110 and has a plurality of air intake holes 130.

The vibrating membrane 110 and the fixed membrane 120 are disposed at a predetermined distance from each other, and the predetermined distance defines an air layer 140 and prevents contact between the vibrating membrane 110 and the fixed membrane 120.

In detail, in the non-directional microphones 30 and 50, as sound from the sound processor 5 travels to the vibrating membrane 110 through the air intake holes 130, the vibrating membrane 110 vibrates, and as the vibrating membrane 110 vibrates, a gap between the vibrating membrane 110 and the fixed membrane 120 changes.

Accordingly, a capacitance between the vibrating membrane 110 and the fixed membrane 120 changes, and the changed capacitance is converted into an electrical signal and sensed by a circuit.

The non-directional microphones 30 and 50 are a first non-directional microphone 30 and a second non-directional microphone 50.

The first non-directional microphone 30 transmits a sound voltage generated by sound traveling inside from the sound processor 5 to the semiconductor chip 90.

On the other hand, the second non-directional microphone 50 forms a directional microphone 70 by including the sound hole 11 and the phase delay membrane 13 of the case 10.

The directional microphone 70 blocks sound in undesired directions and captures the sound in desired directions by delaying the phases of sounds traveling inside through the sound hole 11, using the phase delay membrane 13, thus improving a signal-to-noise ratio (SNR).

The semiconductor chip 90 is connected to the first non-directional microphone 30 and operates in response to input signals.

The semiconductor chip 90 senses the sound voltage input from the first non-directional microphone 30 and measures the magnitude of a noise voltage to the sound voltage.

The semiconductor chip 90 may be an application specific integrated circuit (ASIC).

The semiconductor chip 90 compares the magnitude of the noise voltage with the magnitude of a reference voltage set in the semiconductor chip 90.

The semiconductor chip 90 operates the first non-directional microphone 30 when the magnitude of the noise voltage is less than the magnitude of the predetermined reference voltage set in the semiconductor chip 90.

When the magnitude of the noise voltage is greater than the magnitude of the reference voltage set in the semiconductor chip 90, the semiconductor chip 90 operates the directional microphone 50.

FIG. 2A is a graph showing performance according to a change of the environment in a vehicle equipped with only a non-directional microphone, and FIG. 2B is a graph showing performance according to a change of the environment in a vehicle equipped with only a directional microphone.

Referring to FIG. 2A, the non-directional microphone has a stable frequency response and relatively high sensitivity, but when noise is transmitted into the vehicle, it shows a rapid increase 200*a* of a noise signal and shows vulnerability to the noise.

On the contrary, referring to FIG. 2B, the directional microphone has a defect that sensitivity reduces as frequency decreases, but even if noise is transmitted into the vehicle, it shows an increase of 200*b* and shows strength against the noise transmitted in other directions.

Accordingly, the microphone device 1 according to an exemplary embodiment of the present inventive concept has an excellent SNR, because when the first non-directional microphone 30 operates, it captures sound with excellent sensitivity, and when the second non-directional microphone 50 operates as the directional microphone 70, it reduces the noise voltage.

Figure 3:
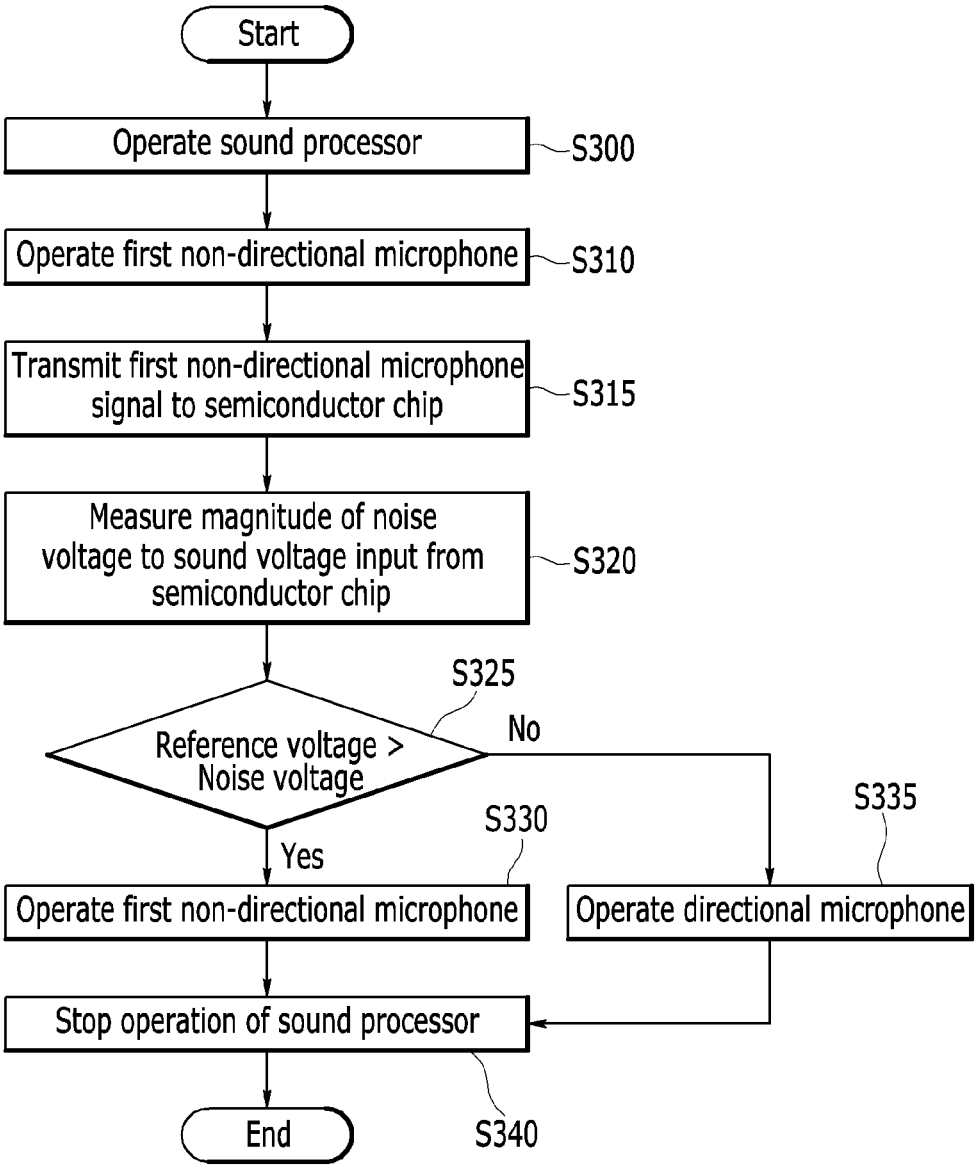
FIG. 3 is a flowchart illustrating a method of controlling a microphone device according to an exemplary embodiment of the present inventive concept.

FIG. 3 is a flowchart illustrating a method of controlling a microphone device according to an exemplary embodiment of the present inventive concept.

Referring to FIG. 3, the sound processor 5 starts to operate (S300).

The sound processor 5, which processes a voice in a vehicle, may be at least one of a speech recognition device, a hands-free device, and a portable communication terminal.

As the sound processor 5 starts to operate, the first non-directional microphone 30 operates (S310).

The first non-directional microphone 30 transmits a sound voltage input from the sound processor 5 to the semiconductor chip 90 (S315).

The semiconductor chip 90 measures the magnitude of a noise voltage to the sound voltage input from the first non-directional microphone 30 (S320).

The semiconductor chip 90 compares the noise voltage with a reference voltage (S325).

When the noise voltage is less than the reference voltage, the semiconductor chip 90 again operates the first non-directional microphone 30 and then stops the sound processor 5 (S330).

When the noise voltage is over the reference voltage, the semiconductor chip 90 operates the second non-directional microphone 50 as the directional microphone 70 and then stops the sound processor 5.

Therefore, the microphone device 1 according to an exemplary embodiment of the present inventive concept can have an excellent SNR by selectively operating a non-directional microphone and a directional microphone, depending on the environment of the vehicle.

While this disclosure has been described in connection with what is presently considered to be practical exemplary embodiments, it is to be understood that the disclosure is not limited to the disclosed embodiments, but on the contrary, is intended to cover various modifications and equivalent arrangements included within the spirit and scope of the appended claims.

What is claimed is:

1. A microphone device comprising:

a case having a sound hole and a phase delay membrane;

a plurality of non-directional microphones disposed in the case; and a semiconductor chip connected to the plurality of non-directional microphones and operating in response to input signals, wherein any one of the non-directional microphones forms a directional microphone by connecting to the sound hole and the phase delay membrane of the case, the non-directional microphones include a first non-directional microphone and a second non-directional microphone, the second non-directional microphone forms a directional microphone by connecting to the sound hole and the phase delay membrane of the case, and the semiconductor chip measures a noise voltage from a sound voltage sensed by the first non-directional microphone, and determines whether the noise voltage is less than a reference voltage set in advance in the semiconductor chip when a sound processor starts to operate, operates the first non-directional microphone when the noise voltage is less than the reference voltage set in the semiconductor chip, and operates the second non-directional microphone as the directional microphone when the noise voltage is more than the reference voltage set in the semiconductor chip.

2. The microphone device of claim 1, wherein the non-directional microphone includes:

a substrate having a penetration hole;

a vibrating membrane disposed on the substrate; and a fixed membrane spaced apart from the vibrating membrane.

3. The microphone device of claim 1, wherein the phase delay membrane is connected to a penetration hole of any one of the non-directional microphones.

4. The microphone device of claim 1, wherein the case has any one of a circular cylinder shape and a rectangular cylinder shape.

5. The microphone device of claim 1, wherein the sound processor is at least any one of a speech recognition device, a hands-free device, and a portable communication terminal.

6. The microphone device of claim 2, wherein the phase delay membrane is connected to the penetration hole of any one of the non-directional microphones.

7. The microphone device of claim 2, wherein the vibrating membrane includes a plurality of slots and the fixed membrane includes a plurality of air intake holes.

8. The microphone device of claim 1, wherein the sound hole is formed on a top side thereof and the phase delay membrane formed on a bottom side thereof.

9. The microphone device of claim 1, wherein the plurality of non-directional microphones are non-directional microelectromechanical system (MEMS) microphones.

10. A method of controlling a microphone device, comprising steps of:

operating a first non-directional microphone or a second non-directional microphone, when a sound processor starts to operate;

transmitting a sound voltage generated by the first non-directional microphone to a semiconductor chip;

measuring a noise voltage from a sound voltage input to the semiconductor chip, and comparing the noise voltage with a reference voltage set in advance in the semiconductor chip;

operating the first non-directional microphone, when the noise voltage is less than the reference voltage;

operating the second non-directional microphone as a directional microphone, when the noise voltage is more than the reference voltage, after the step of measuring and comparing; and stopping the operation of the sound processor.

* * * * *